United States Patent [19]

Heimberger

[11] 4,043,007

[45] Aug. 23, 1977

[54] WARP-KNIT SLIDE-FASTENER SUPPORT TAPE AND STRINGER

[75] Inventor: Helmut Heimberger, Locarno, Switzerland

[73] Assignee: OPTI Patent-, Forschungs- und Fabrikations-AG, Glarus, Switzerland

[21] Appl. No.: 728,133

[22] Filed: Sept. 30, 1976

[30] Foreign Application Priority Data

June 15, 1976 Germany ..... 2626661

[51] Int. Cl.[2] ..... A44B 19/00

[52] U.S. Cl. ..... 24/205.1 C; 66/195

[58] Field of Search ..... 66/190–195; 24/205.1 C, 205.16 C, 205.1 R

[56] References Cited

U.S. PATENT DOCUMENTS

| | | | |
|---|---|---|---|
| 3,820,202 | 6/1974 | Takamatsu | 24/205.1 C |
| 3,926,017 | 12/1975 | Matsuda | 66/195 |

*Primary Examiner*—Ronald Feldbaum

*Attorney, Agent, or Firm*—Karl F. Ross; Herbert Dubno

[57] ABSTRACT

A support tape for a slide-fastener stringer half is knitted on a Raschel knitting machine having a pair of needle bars. This tape has a pair of longitudinally extending edges and a pair of opposite faces and is knit with an intermediate warp yarn that is spaced from the edges and knit with both needle bars to form a longitudinally extending double wale that projects on both faces of the tape and subdivides the tape transversely into an attachment strip and an edge strip. A plurality of first warp yarns in only the attachment strip are knit with one needle bar and form a plurality of longitudinally extending single wales projecting only on one face of the tape, and a plurality of second warp yarns in only the edge strip are knit with the other needle bar and form a plurality of longitudinally extending single wales projecting only on the other face of the tape. A multiplicity of weft yarns are laid into the warp yarns and each extend transversely over at least one of the wales. The edge region is wrapped around a filler cord and the edgemost wale is stitched to the double wale to hold the filler cord in place so that afterward a succession of coupling teeth may be fitted over the welted edge of the tape.

12 Claims, 5 Drawing Figures

FIG. 5
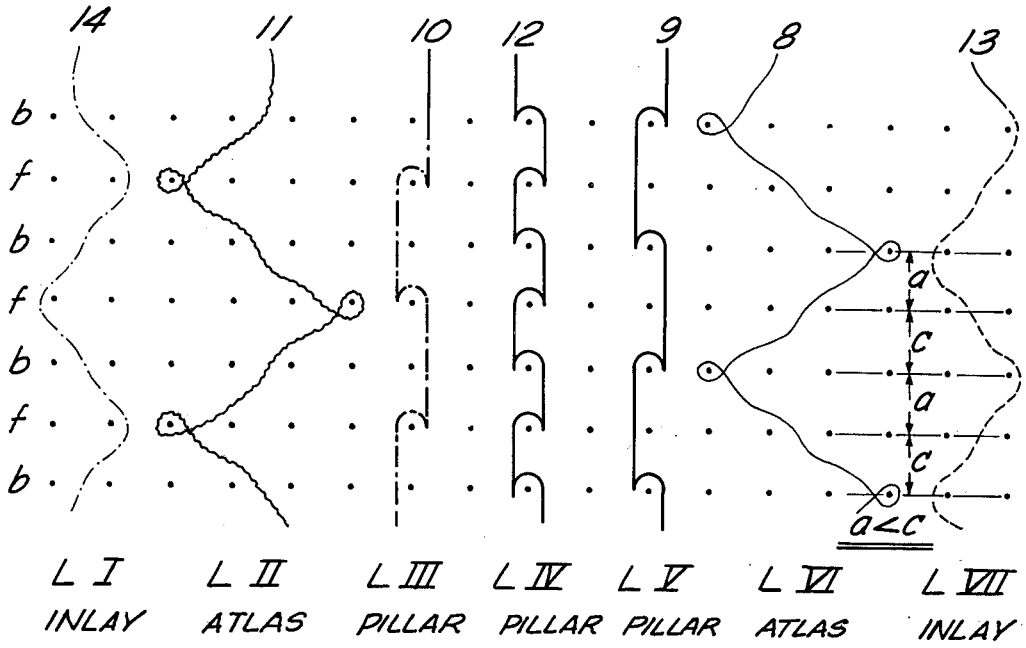
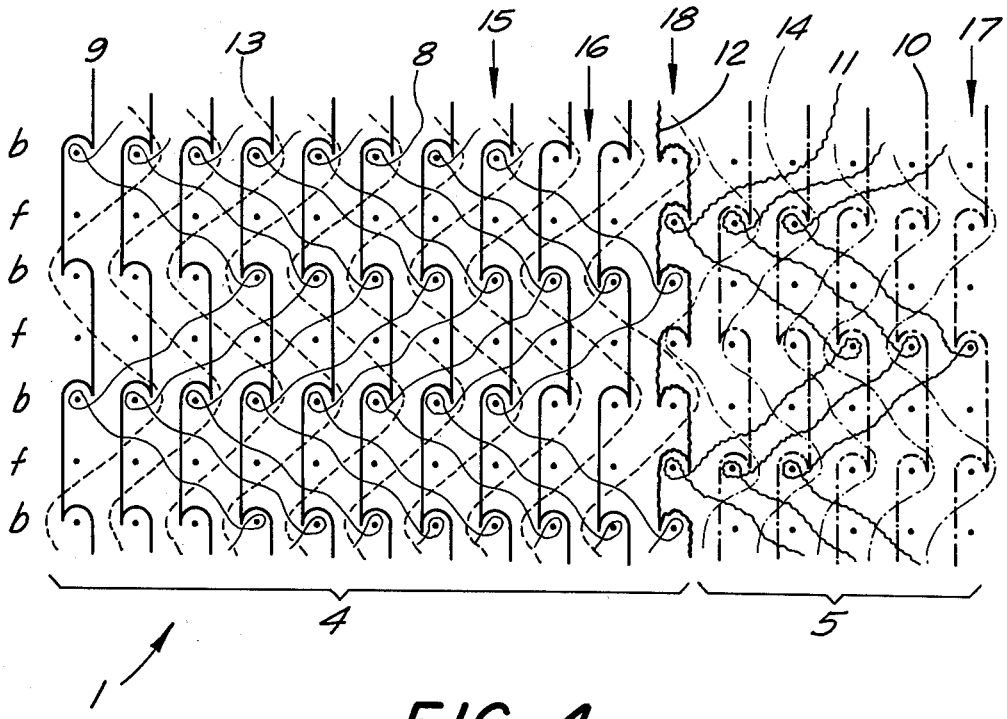
FIG. 4

WARP-KNIT SLIDE-FASTENER SUPPORT TAPE AND STRINGER

CROSS-REFERENCE TO RELATED APPLICATIONS

This application is related to my commonly assigned and copending patent applications Ser. Nos. 728,031 to 728,033, Ser. No. 728,132 and Ser. Nos. 728,134 to 728,136, all filed

FIELD OF THE INVENTION

The present invention relates to a slide-fastener stringer half. More particularly this invention concerns a warp-knit tape having an edge welt formed by a bound-in filler cord over which is mountable a succession of coupling-element teeth.

BACKGROUND OF THE INVENTION

It is known to subdivide a support tape for a slide-fastener stringer half into an edge strip and an attachment strip. The edge strip is bent over into a U-shape around a filler cord and at the extreme or free edge of the edge strip is sewn or otherwise secured to the region of the tape between the two strips. It is then possible to fit a succession of slide-fastener coupling heads over this thickened edge or welt. Each of these coupling heads has a pair of legs which straddle the welt. Such coupling heads may be made of metal or synthetic resin, and in the case of synthetic resin can be molded directly onto the tape. Such a slide-fastener coupling half is typically used for heavy-duty or large-size slide fasteners.

Since it is essential that such a slide fastener have extremely good longitudinal and transverse dimensional stability such a support tape has been woven heretofore. In particular it has not been found possible to date to form a knitted support tape which is not longitudinally so elastic as to be useless in a slide-fastener stringer of this type.

OBJECTS OF THE INVENTION

It is therefore an object of the present invention to provide an improved knitted slide-fastener support tape for the purposes described.

Another object is the provision of such a support tape which is knitted, yet which has extremely good longitudinal dimensional stability.

Still another object is to provide such a support tape which can be combined with a filler cord as described above.

Yet another object of the invention is to provide a slide-fastener stringer of an improved type.

SUMMARY OF THE INVENTION

These objects are attained according to the present invention in a support tape having an intermediate warp yarn spaced from the edges and forming a longitudinally extending double wale projecting on both faces of the tape and subdividing the tape transversely into an attachment strip and an edge strip. A plurality of first warp yarns in only the attachment strip form a plurality of longitudinally extending single wales projecting on only one face of the tape. A plurality of second warp yarns in only the edge strip form a plurality of longitudinally extending single wales projecting only on the other face of the tape. A multiplicity of weft yarns are laid or lapped into the warp yarns and each extend transversely over at least one of the wales.

According to another feature of this invention such a tape is warp-knitted on a Raschel machine having two needle bars and a plurality of guide bars. The double wale is formed by chaining the intermediate warp yarn with both of the needle bars. The firstand second warp yarns are each chained only on a respective one of the needle bars.

According to still another feature of this invention a filler cord is wrapped in the edge strip and the single wale at the longitudinal edge of the tape on the edge strip is stitched or welded to or near the double wale subdividing the tape into the two strips. Thereafter, particularly when the warp yarns of the edge strip are cotton, these cotton filaments are shrunk so as tightly to secure the filler cord in place. Thereafter a succession of coupling heads or teeth are fitted straddle-fashion over the welt formed at the edge of the tape.

According to yet another feature of this invention the weft yarns comprise two groups. The first group is laid in over two courses. Once again the laid-in weft filaments of the attachment strip knitted with the front needle bar are reversed only at the front needles, and the laid-in weft filaments of the edge strip are reversed only at the rear needles. The second groups of weft filaments are Atlas-lapped, once again with loops only formed at the respective needles. Such Atlas-lapping is effected over four wales so as to give the tape maximum transverse stability too.

The tape according to the present invention can therefore be made of extremely durable knitted goods. In spite of such knit construction extremely good longitudinal stability is obtained by the use of the particularly inelastic double wale up the center in combination with the preferably inelastic filler cord. Such a support tape has the considerable advantage that the outside of the welt will be formed with longitudinally extending ridges constituted by the wales so that the coupling head or teeth can be readily secured to this welt. The production of such a tape in a double-needle-bar Raschel machine with seven guide bars is a relatively simple procedure.

According to another aspect of the invention a slide-fastener stringer half comprises a tape having a stitching strip whereby the stringer half can be attached to a garment or the like and a welt-forming strip knitted unitarily with the stitching strip and folded over a filler cord to form a bead, the coupling element or chain of coupling heads extending over and being mounted upon this bead preferably by being injection-molded thereon.

The strips are formed as a right-left knit from loop-forming warp yarns and weft yarns with loop warp pillars and valleys between the warp pillars. The rod-like valleys lie on the upper surface of the stitching strip and on the underside of the welt-forming strip. Between the stitching strip and the welt-forming strip there is provided an intermediate strip formed by right-right warp knitting with at least one loop pillar and the terminal loop pillar of the edge strip is fastened, e.g. by a sewing seam, to the intermediate strip. The fastening can however also be by thermal or ultrasonic fusion.

The warp-knit loop pillars in each case are preferably not interconnected except by a chained-in, lapped or simple inlaid weft. These loop pillars can be of the type of warp chains described in German open application DT-OS No. 2 016 141, or U.S. Pat. No. 3,708,830, or in the above-mentioned application Ser. No. 728,134.

Preferably the stitching strip is composed entirely of synthetic-resin yarns (most advantageously polyester staple yarn) while the welt-forming strip is formed entirely of cotton yarn and the filler cord or yarn is likewise of cotton.

Advantageously the welt-forming strip is shrunk onto the filler cord to grip it uniformly over its periphery and length.

BRIEF DESCRIPTION OF THE DRAWING

The above and other objects, features and advantages of the invention will become more readily apparent from the following description, reference being made to the accompanying drawing in which:

FIG. 4 is a large-scale diagrammatic view illustrating the knit of the tape of FIGS. 1 - 3; and FIG. 5 is a point-paper diagram illustrating patterning of the yarns of the knit of FIG. 4.

SPECIFIC DESCRIPTION

Figure 2:
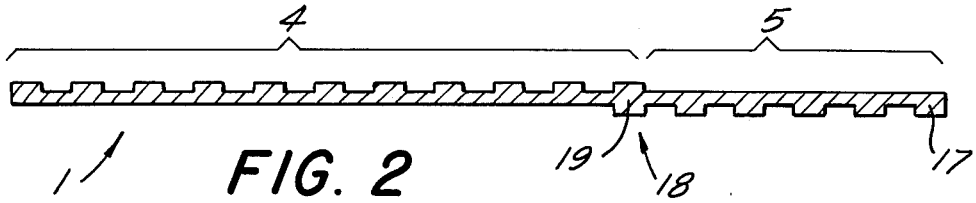
FIG. 2 is a section taken along line II — II of FIG. 1.
Figure 1:
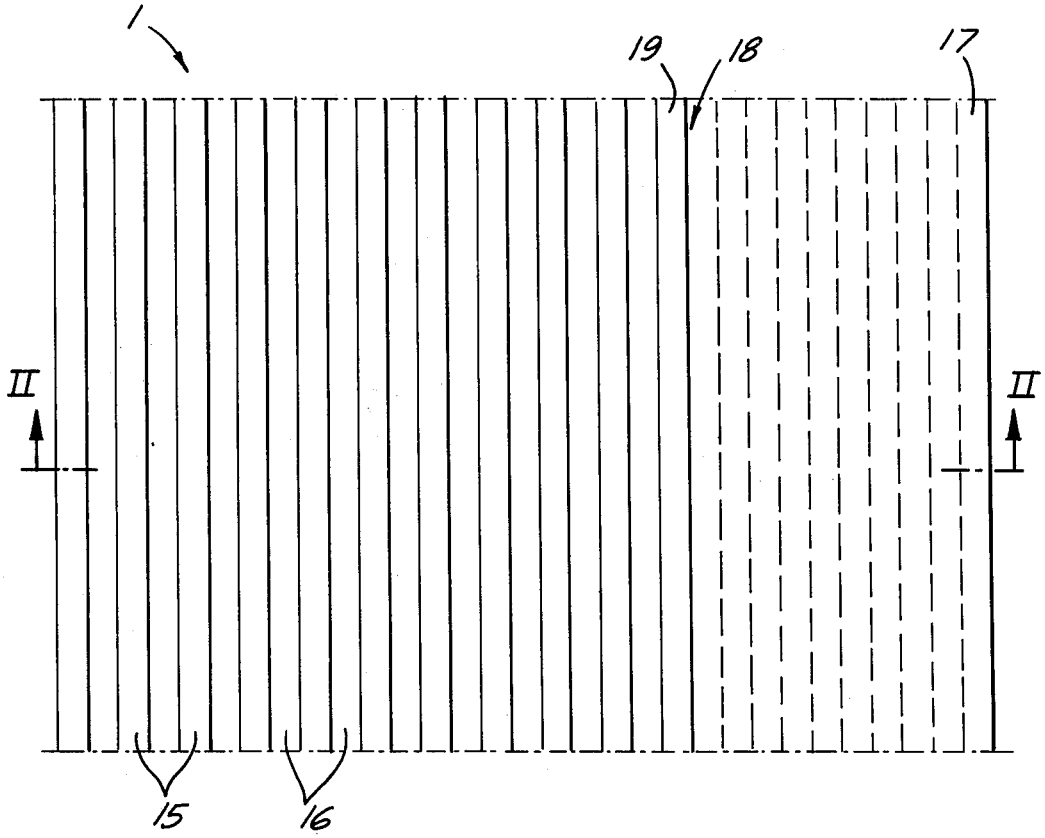
FIG. 1 is a top view of a portion of a support tape according to this invention.

As shown in FIGS. 1 and 2 a support tape 1 according to this invention is subdivided at an intermediate region 18 into an attachment strip 4 and an edge strip 5. The subdivision at 18 is formed by a double wale 19. In the edge strip 5 the tape has on one face a plurality, here five, of single wales 17. On its other face it has a plurality of single wales 15 separated by valleys or troughs 16.

Figure 3:
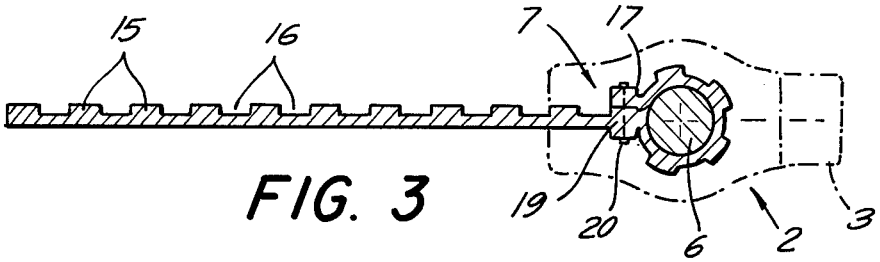
FIG. 3 is a section similar to FIG. 2, but showing the filler cord in place ready to receive a coupling tooth.

In use as shown in FIG. 3 a cotton filler cord 6 is juxtaposed with the smooth face of the edge strip 5, this strip 5 is wrapped around the cord 6 tightly, and the edgemost wale 17 is secured to the double wale 19 as shown at 7 by means of stitching 20. The tape edge 2 thus formed is ideally suited for receiving a succession of coupling teeth 3 indicated in dot-dash lines. The ridges formed by those single wales 17 serve well to secure the coupling teeth 3 in place. In accordance with this invention the filaments constituting the strip 5 are, like the cord 6, of cotton. This allows the teeth 3 to be molded in place over the edge 2.

As shown in more detail in FIGS. 4 and 5 it is possible to make the tape shown in FIGS. 1 - 3 on a Raschel knitting machine having front (f) and back (b) needle bars and seven guide bars LI - LVII. The double wale 19 is formed by a warp pillar in turn constituted by a warp filament 12 chained in open loops by means of the guide bar LIV with both the front and back needle bars as shown in FIG. 5.

The attachment region is formed of a pillar in turn constituted by a warp filament 10 chained by means of guide bar LIII on the front needle bar. In addition this attachment region 4 is formed by Atlas weft filaments 11, Atlas-lapped by means of guide bar LII and forming closed loops again only on the front needle bar, and by weft filaments 14 laid in by guide bar LI and reversing only at the front needle bar.

The edge strip 5 is formed of a plurality, here five, of pillars constituted by warp yarns 9 chained into open loops by guide bar LV on the back needle bars. In addition this strip 5 is formed of weft filaments 8 Atlas- (or satin-) lapped by guide bar LVI again only on the back guide bar and weft filaments 13 laid in by guide bar LVII and reversing at the needle bar. It is noted that in all the above the yarns are tensioned so that the spacing between a course formed by a front needle bar and that formed by the following back needle bar is greater than the distance formed between a back needle bar and that formed by the following needle bar.

Thus the yarns are patterned as follows:

Laid-in yarn 14 (LI) — 0-0/2-2/4-4/2-2;
Atlas-lapped weft yarn 11 (LII) — 6-8/4-4/2-0/4-4;
Warp yarn 10 (LIII) — 2-0/0-0/0-2/2-2;
Warp yarn 12 (LIV) — 2-0/0-2;
Warp yarn 9 (LV) — 2-2/2-0/0-0/0-2;
Atlas-lapped weft yarn 8 (LVI) — 4-4/6-8/4-4/2-0;
Laid-in weft yarn 13 (LVII) — 2-2/0-0/2-2/4-4.

The yarns 14, 11 and 10 are knitted with the front needle bar only. The yarn 12 is knitted with both needle bars. The yarns 9, 8 and 13 are knitted with the back needle bar only.

After forming of the tape shown in FIG. 2 and incorporation therein of the filler cord 6, the entire assembly is subjected to a heat-treatment operation. This shrinks the yarns and binds the cord 6 tightly in place. It is possible in accordance with this invention to replace the stitching 20 with a thermal weld.

I claim:

1. A support tape for a slide-fastener stringer half, said tape having a pair of longitudinally extending edges and a pair of opposite faces and being warp knit with:

an intermediate warp yarn spaced from said edges and forming a longitudinally extending double wald projecting on both faces of said tape and subdividing same transversely into an attachment strip and an edge strip;

a plurality of first warp yarns in only said attachment strip forming a plurality of longitudinally extending single wales projecting only on one face of said tape;

a plurality of second warp yarns in only said edge strip forming a plurality of longitudinally extending single wales projecting only on the other face of said tape; and a multiplicity of weft yarns laid into said warp yarns and each extending tranversely over at least one of said wales.

2. The support tape defined in claim 1, further comprising a filler cord engaging said edge strip at said one face only, and means for securing the single wale at said edge on said edge strip to said tape at said intermediate yarn after wrapping of said edge strip around said filler cord.

3. The support tape defined in claim 2 wherein said second warp yarns and said filler cord are shrunk.

4. The support tape defined in claim 2 wherein said second warp yarns are shrunk.

5. The support tape defined in claim 4 wherein said filler cord is cotton.

6. A slide-fastener stringer half comprising:

a support tape having a stitching strip knitted unitarily with a welt-forming strip and an intermediate strip between said stitching strip and said welt-forming strip, said strips being warp knit with warp loop pillars and longitudinally extending valleys between them, the valleys lying along an upper surface of said stitching strip and along an undersurface of said welt-forming strip, said welt-forming strip having a free edge secured to said intermediate strip;

a filler lying in and surrounded by said welt-forming strip while defining a head along an edge of the tape therewith; and a row of coupling members mounted on said head along said edge of the tape.

7. The slide-fastener stringer half defined in claim 6 wherein said warp loop pillars are interconnected only by a weft, said stitching strip and said welt-forming strip being right-left Raschel knits and said intermediate strip being a right-right Raschel knit, said free edge of said welt-forming strip being provided with a respective one of said warp loop pillars and being secured to a warp loop pillar of said intermediate strip.

8. The slide-fastener stringer half defined in claim 7 wherein:

said warp loop pillars are formed by warp yarns in 2-2/2-0/0-0/0-2 pattern along said stitching strip, in 2-0/0-2 pattern at said intermediate strip and in 2-0/0-0/0-2/2-2 pattern at said welt-forming strip; and said weft includes:

an inlay over two warp chains with 0-0/2-2/4-4/2-2 pattern at said stitching strip, an inlay over two warp chains with 2-2/0-0/2-2/4-4 pattern at said welt-forming strip, a lapped weft extending over four warp chains in said welt-forming strip and said intermediate strip with 6-8/4-4/2-0/4-4 pattern, and a lapped weft extending over four warp chains in said stitching strip and to said intermediate strip with4-4/6-8/4-4/2-0 pattern.

9. The slide-fastener stringer half defined in claim 8 wherein said warp loop pillar at said free edge of said welt-forming strip is secured to said intermediate strip by a stitch seam.

10. The slide-fastener stringer half defined in claim 9 wherein said welt-forming strip is shrunk onto said filler.

11. The slide-fastener stringer half defined in claim 10 wherein said welt-forming string is composed of cotton yarn.

12. The slide-fastener stringer half defined in claim 11 wherein said filler is composed of cotton yarn.

* * * * *